US006817341B2

(12) United States Patent
Scheffel

(10) Patent No.: US 6,817,341 B2
(45) Date of Patent: Nov. 16, 2004

(54) COMPENSATION ELEMENT FOR A FUEL INJECTION VALVE

(75) Inventor: Martin Scheffel, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/399,632

(22) PCT Filed: Jun. 11, 2002

(86) PCT No.: PCT/DE02/02122

§ 371 (c)(1),
(2), (4) Date: Nov. 20, 2003

(87) PCT Pub. No.: WO03/018997

PCT Pub. Date: Mar. 6, 2003

(65) Prior Publication Data

US 2004/0089270 A1 May 13, 2004

(30) Foreign Application Priority Data

Aug. 20, 2001 (DE) ..... 101 40 797

(51) Int. Cl.[7] ..... F02M 55/02
(52) U.S. Cl. ..... 123/470; 239/533.11
(58) Field of Search ..... 123/470; 239/533.11; 277/591, 626, 644

(56) References Cited

U.S. PATENT DOCUMENTS

| | | | | |
|---|---|---|---|---|
| 1,970,801 | A | 8/1934 | Hurst | |
| 5,129,658 | A | 7/1992 | Berton et al. | |
| 6,276,339 | B1 * | 8/2001 | Shebert et al. | 123/470 |
| 6,684,861 | B2 * | 2/2004 | Reiter | 123/470 |
| 6,718,949 | B2 * | 4/2004 | Gmelin | 123/470 |
| 2003/0154961 | A1 * | 8/2003 | Uwe | 123/470 |

FOREIGN PATENT DOCUMENTS

| | | |
|---|---|---|
| DE | 197 35 665 | 1/1999 |
| DE | 198 38 755 | 3/2000 |
| JP | 11 210 885 | 8/1999 |

* cited by examiner

*Primary Examiner*—Mahmoud Gimie
(74) *Attorney, Agent, or Firm*—Kenyon & Kenyon

(57) ABSTRACT

A compensating element for supporting a fuel injector in a cylinder head of an internal combustion engine is configured in the form of an intermediate ring and situated between a valve housing of the fuel injector and a wall of a receiving bore of the cylinder head. The compensating element has webs at the intermediate ring which extend along the valve housing and on which support segments are affixed which surround the valve housing, thereby distancing the valve housing from the wall of the receiving bore.

13 Claims, 2 Drawing Sheets

COMPENSATION ELEMENT FOR A FUEL INJECTION VALVE

FIELD OF THE INVENTION

The present invention is directed to a compensating element for a fuel injector.

BACKGROUND INFORMATION

German Published Application No. 197 35 665 describes a fuel injection system that has a compensating element made of a supporting body having a dome-shaped supporting surface. This compensating element supports a fuel injector in a receiving bore of a cylinder head. Since the fuel injector rests on the spherically shaped calotte surface by way of a supporting surface, the fuel injector can be mounted at an angle that deviates from the axis of the receiving bore by up to a certain amount, and can be pressed firmly into the receiving bore using appropriate means, e.g., a clamping shoe. This allows a simple adaptation to be made to the fuel supply lines. Tolerances arising in the manufacture and in the mounting of the fuel injectors can be compensated for.

It is disadvantageous, however, that the supporting body requires expensive manufacturing and that a precisely manufactured, spherical surface is needed. The rigid supporting body cannot be compressed, and thus no compensation in the axial direction of the receiving bore takes place. Moreover, tolerance can only be compensated with respect to the specified geometry of the spherical surface. A radial compensation movement purely with respect to the receiving bore is not possible.

SUMMARY OF THE INVENTION

In contrast, the compensating element according to the present invention for a fuel injector has the advantage over the fuel injector and are in turn connected to sphere-segment-shaped supporting segments which wrap around the fuel injector and thus provide spacing from a wall of a receiving bore of a cylinder head of an internal combustion engine in accordance with the forces exerted on the fuel injector.

The compensating element compensates both for manufacturing tolerances of the individual components as well as for tolerances that are caused by the warming of the fuel injector during operation, and in this manner prevents twisting and misalignments.

It is particularly advantageous that the intermediate ring has a quadrantal-shaped cross section and is positioned between the fuel injector and the wall of the receiving bore in such a way that the fuel injector is able to be flexibly balanced in the receiving bore.

Furthermore, it is advantageous that the intermediate ring is easy to produce from plastic. The webs may be integrally formed with the intermediate ring or be extruded onto it. The totality of the supporting segments advantageously form a circle which completely surrounds the fuel injector. The number of supporting segments preferably amounts to four, these being supported by two or four webs.

The webs may be elongated and have a retaining collar, which allows the compensating element to be affixed to the fuel injector.

DESCRIPTION OF THE EXEMPLARY EMBODIMENTS

Figure 1A:
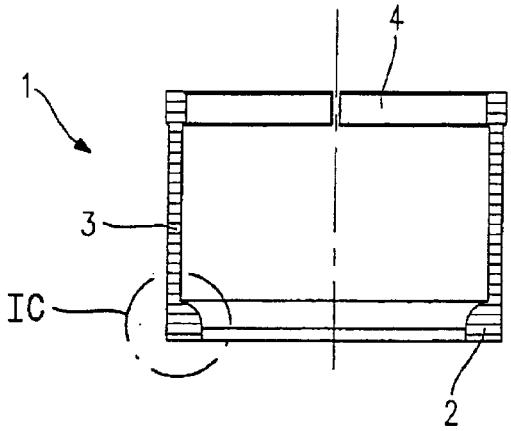
FIG. 1A shows a schematic, part-sectional view of a first exemplary embodiment of a compensating element constructed according to the present invention, for a fuel injector in a cylinder head of an internal combustion engine.

FIG. 1A shows a schematized partial section through a first exemplary embodiment of a compensating element 1 configured according to the present invention, which is suited in particular for aligning a fuel injector in a receiving bore of a cylinder head of a mixture-compressing internal combustion engine having external ignition.

Compensating element 1 is configured in the form of an intermediate ring 2 which has a cross section corresponding to a quadrant in the present first exemplary embodiment. In the mounted state, intermediate ring 2 abuts against a shoulder (not shown in FIG. 1A) of a receiving bore of a cylinder head of an internal combustion engine. Formed on intermediate ring 2 are webs 3 which are extruded onto intermediate ring 2, which is preferably injection molded from plastic, or which-may be integrally formed with intermediate ring 2.

Provided at webs 3, of which there are two in the preferred exemplary embodiment, are support segments 4 which surround the fuel injector in the mounted state of compensating element 1 and ensure that the fuel injector is distanced from a wall 12 of the receiving bore of the cylinder head. There are four support segments 4 in the preferred exemplary embodiment. Support segments 4 are configured in the shape of quadrants, that is, together they form a circle surrounding the fuel injector, the circle having evenly spaced slots. In each case two of support segments 4 are connected to one web 3.

Figure 2A:
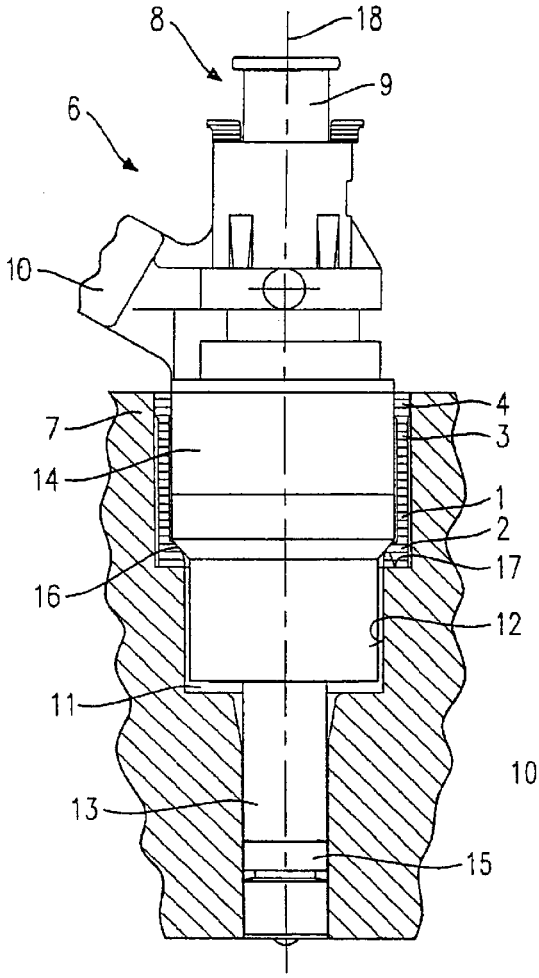
FIG. 2A shows a fuel injector mounted in a centered manner using the compensating element configured according to the present invention, as shown as an exemplary embodiment in FIG. 1A.

For mounting compensating element 1, it is slipped onto the fuel injector to be installed and mounted together with it in the receiving bore of cylinder head 7, as shown in greater detail in FIG. 2A.

Figure 1B:
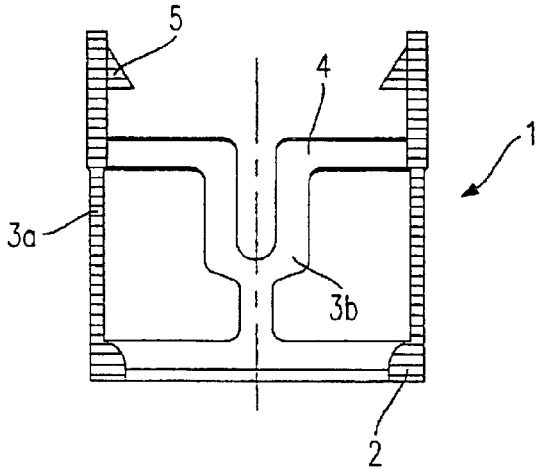
FIG. 1B shows a schematic, part-sectional view of a second exemplary embodiment of a compensating element constructed according to the present invention, for a fuel injector in a cylinder head of an internal combustion engine.

In a part-sectional view, FIG. 1B shows a second exemplary embodiment of a compensating element 1 configured according to the present invention. Components corresponding to the exemplary embodiment shown in FIG. 1A have been provided with the same reference numerals.

The second exemplary embodiment of a compensating element 1 according to the present invention also has an intermediate ring 2 at which webs 3 are formed. In the present exemplary embodiment four webs 3 are provided, two of which, lying across from one another in each case, being configured as holding webs 3*a* and slotted webs 3*b*.

Holding webs 3*a* are extended compared to webs 3 described in FIG. 1A and provided with a retaining collar 5 which may be used to affix compensating element 1 to the fuel injector by clipping it onto a shoulder of the same, for instance. Retaining collar 5 is configured as a graduated circle and may have a width that corresponds to the width of holding webs 3*a*. For better fixation of compensating element 1, retaining collar 5 may also be radially enlarged.

Slotted webs 3*b* are configured to stabilize support segments 4 and designed in such a way that they are unslotted on a side facing intermediate ring 2 and slotted on a side facing support segments 4. In this way, each of the quadrantal support segments 4 is affixed to one of holding webs 3*a* by way of one end and to one of slotted webs 3*b* by way of the other end. This provides better support for support segments 4 and retains the shape of compensating element 1, which in turn allows a simpler installation since compensating element 1 is not so sensitive in response to bending or distortion during mounting.

The installation position and the function of compensating element 1 according to the present invention are shown more clearly in FIGS. 2A and 2B and described in detail in the specification below.

Figure 1C:
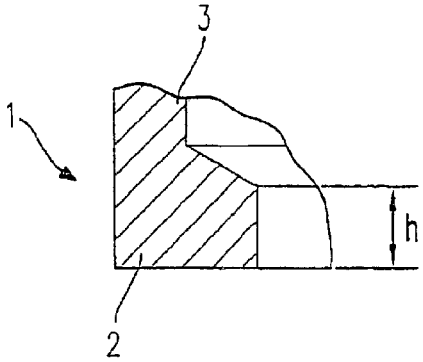
FIG. 1C shows a schematic cut-out section from the first exemplary embodiment of a compensating element configured according to the present invention as shown in FIG. 1A, in the area IC in FIG. 1A.

Intermediate ring 2 shown in FIGS. 1A and 1B, which has a cross section corresponding to a quadrant, may also have an angular cross section as shown in the cut-out portion designated IC in FIG. 1A, this section being shown in an enlarged view in FIG. 1C. Height h of intermediate ring 2 is variable and may be selected such that it is appropriate for the particular structural design of the fuel injector and the receiving bore of the cylinder head.

Figure 2B:
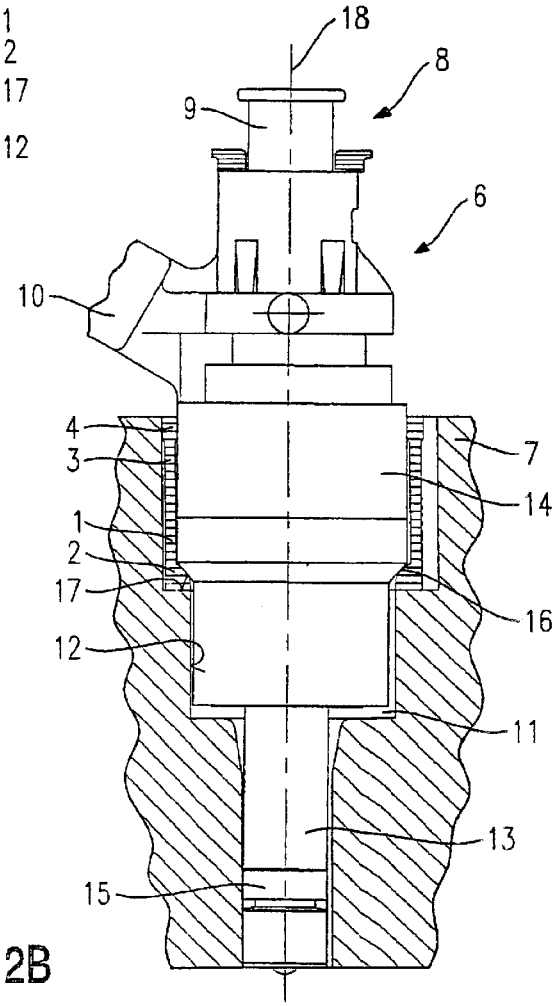
FIG. 2B shows a fuel injector mounted with the aid of the compensating element configured according to the present invention shown as an exemplary embodiment in FIG. 1A, utilizing the tolerances.

In a part-sectional view, FIGS. 2A and 2B show a compensating element 1 according to FIG. 1A, which is mounted with a fuel injector 6 in a receiving bore 11 of a cylinder head 7 of an internal combustion engine.

FIG. 2A shows an installation situation in which compensating element 1 and fuel injector 6 are evenly spaced from a wall 12 of receiving bore 11 of cylinder head 7, or the overall component made up of compensating element 1 and fuel injector 6 is centered in receiving bore 11. FIG. 2B shows the situation, for instance, after fuel injector 6 has been connected to a fuel distributor line (not shown) which caused fuel injector 6 to shift, so that it is no longer in a centered position in receiving bore 11 of cylinder head 7.

Before addressing in detail the aforementioned installation situation, a brief description will follow of the essential parts of a fuel-injection system that is suitable to be mounted with the aid of compensating element 1 configured according to the present invention.

In this case, the fuel injector is designed in the form of a directly injecting fuel injector 6 and installed in a cylinder head 7 of an internal combustion engine. At an end 8 on the inflow-side, fuel injector 6 is provided with a plug connection to a fuel-distributor line (not shown further), which may be sealed by a seal situated between the fuel distributor line and a supply connection 9 of fuel injector 6. Fuel injector 6 has an electrical connection 10 for the electrical contacting to activate fuel injector 6. Fuel injector 6 also has a valve housing 14 and a nozzle body 13 projecting beyond it on a downstream side. Situated on nozzle body 13 is a seal 15 which seals cylinder head 7 from the combustion chamber of the internal combustion engine.

At its valve housing 14, fuel injector 6 has a shoulder 16 which is tilted at an angle of 45°, for example. This shoulder 16 normally rests on an at least similarly tilted shoulder 17 of receiving bore 11 of cylinder head 7. A tolerance compensation between fuel injector 6 and receiving bore 11 is only possible to a very unsatisfactory degree.

In the present exemplary embodiment, shoulder 17 in combination with compensating element 1 according to the present invention has a rectangular design, so that intermediate ring 2 of compensating element 1 rests on shoulder 17 by way of its flat side and supports the side having a graduated-circle design of fuel injector 6.

For mounting, compensating element 1 is placed on shoulder 17 of cylinder head 7 or slipped onto valve housing 14, thereby opening up the previous shoulder fit between fuel injector 6 and receiving bore 11 to a distance corresponding to the diameter of intermediate ring 2 of compensating element 1. FIG. 2A shows the corresponding installation situation prior to fuel injector 6 being connected to the fuel-distributor line (not shown).

The position of intermediate ring 2 makes it possible for it to assume an optimal position under the circumstances, which may also result, for instance, in compensating element 1 and fuel injector 6 being able to be tilted with respect to a longitudinal axis 18 of fuel injector 6 or receiving bore 11. In combination with support segments 4, which surround valve housing 14 and are flexibly affixed to webs 3 extending in parallel to valve housing 14 of fuel injector 6, this makes the desired tolerance compensation possible, thereby preventing radial stresses from building up and subsequent malfunctions of fuel injector 6, for instance, by tilting of components inside the same.

Compensating element 1 of the present invention according to FIG. 1A or FIG. 1B fulfills several functions. On the one hand, fuel injector 6 is able to be centered by distancing fuel injector 6 from a wall 12 of receiving bore 11 of cylinder head 7, this centering counteracting a too severe tilting of fuel injector 6, for example in the region of nozzle body 13 of fuel injector 6, in this way contributing to the sealing effect of a sealing ring 15 slipped onto nozzle body 13, which seals cylinder head 7 from the combustion chamber (not shown further) of the internal combustion engine.

Moreover, without requiring expensive reworking of the components, compensating element 1 is able to compensate for manufacturing tolerances of the individual components, such as nozzle body 13 or a valve housing 14, which lead to asymmetries in fuel injector 6.

Compensating element 1 may also compensate for temperature-related tolerances, which may occur, for instance, as a result of warming of fuel injector 6 and of cylinder head 7 during operation of the internal combustion engine. For example, tolerances of this kind may lead to stresses and warping of the plug connection between fuel injector 6 and the fuel distributor line (not shown further).

The fitting of compensating element 1 with respect to fuel injector 6 may be accomplished either by clearance fit of by press-fit. The clearance fit, which allows compensating element 1 to assume an optimal position according to the prevailing conditions, lends itself, in particular, to exemplary embodiments of compensating elements 1 according to FIG. 1A. Press-fit, on the other hand, is particularly easy to realize in compensating elements 1 according to FIG. 1B since retaining collar 5 of holding webs 3*a* retains compensating element 1 at fuel injector 6, thereby not only distancing fuel injector 6 with respect to wall 12 of receiving bore 11, but also providing an effective protection against loss of compensating element 1 during installation and disassembly of fuel injector 6.

When fuel injector 6, as shown in FIG. 2B, is tilted in receiving bore 11, for instance, by connecting a fuel distributor line (not shown further), this will occur within the framework of predefined tolerance values which are limited by the geometry of compensating element 1 and receiving bore 11. Fuel injector 6, while no longer centered in receiving bore 11, but shifted by a maximum value of, for instance, ±0.2 mm and/or additionally tilted at an angle, is not affected in its function nor are additional components, such as sealing ring 15, since fuel injector 6 continues to be straight in itself, and valve housing 14 and nozzle body 13 are not bent by axial forces. Given sufficient flexibility of sealing ring 15, a satisfactory sealing of cylinder head 7 from the combustion chamber continues to be possible. Longitudinal axis 8 of fuel injector 6, thus, is slightly tilted with respect to the position assumed in FIG. 2A; however, this does not adversely affect the function of the individual components.

Support segments 4 not shown in FIGS. 2A and 2B may at all times provide an optimal spacing of fuel injector 6 from wall 12 of receiving bore 11, while intermediate ring 2 of compensating element 1 allows a balanced compensation of movements occurring at the inflow-side end 8 of fuel injector 6 and also of tolerances caused by warming.

The present invention is not limited to the exemplary embodiments shown and also suitable, for instance, for compensating elements 1 having differently formed intermediate rings 2 and more or fewer support segments 4 or webs 3. Likewise, the present invention is applicable to various configurations of fuel injectors 6, for instance, for fuel injectors 6 for injection into the combustion chamber of an internal combustion engine having self-ignition.

What is claimed is:

1. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

support segments; and a plurality of webs at the intermediate ring that extend along the valve housing and on which the support segments are affixed, the support segments wrapping around the valve housing to distance the valve housing from the wall of the receiving bore;

wherein:

the intermediate ring is injection-molded from plastic.

2. The compensating element as recited in claim 1, wherein:

the intermediate ring has a quadrantal-shaped cross section.

3. The compensating element as recited in claim 1, wherein:

the support segments together form a circle.

4. The compensating element as recited in claim 1, wherein:

a number of the webs is two.

5. The compensating element as recited in claim 1, wherein:

a number of the webs is four.

6. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

Support segments; and a plurality of webs at the intermediate ring that extend along the valve housing and on which the support segments are affixed, the support segments wrapping around the valve housing to distance the valve housing from the wall of the receiving bore;

wherein:

a number of the webs is four; and in each case two of the webs lying across from one another are configured as holding webs.

7. The compensating element as recited in claim 6, further comprising:

a retaining collar formed on the holding webs.

8. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

support segments; and a plurality of webs at the intermediate ring that extend along the valve housing and on which the support segments are affixed, the support segments wrapping around the valve housing to distance the valve housing from the wall of the receiving bore;

wherein:

a number of the webs is four; and in each case two of the webs lying across from one another are configured as slotted webs.

9. The compensating element as recited in claim 8, wherein:

in each case two of the webs lying across from one another are configured as holding webs, and the support segments, by way of one end in each case, are affixed to one of the holding webs and by way of another end to one of the slotted webs.

10. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

support segments; and a plurality of webs at the intermediate ring that extend along the valve housing and on which the support segments are affixed, the support segments wrapping around the valve housing to distance the valve housing from the wall of the receiving bore;

wherein:

the webs are one of injection-molded onto the intermediate ring and integrally formed therewith.

11. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

support segments; and a plurality of webs at the intermediate ring that extend along the valve housing and on which the support segments are affixed, the support segments wrapping around the valve housing to distance the valve housing from the wall of the receiving bore;

wherein:

the intermediate ring has a guadrantal-shaped cross section; and the intermediate ring abuts against a shoulder of the fuel injector by way of the quadrantal-shaped camber, and at a shoulder of the receiving bore of the cylinder head by way of a flat side.

12. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

support segments; and a plurality of webs at the intermediate ring that extend along the valve housing and on which the support segments are affixed, the support segments wrapping around the valve housing to distance the valve housing from the wall of the receiving bore;

wherein:

the intermediate ring includes one of a trapezoidal cross section and a rectangular cross section of an axial height.

13. A compensating element for supporting a fuel injector in a cylinder head of an internal combustion engine, the compensating element being situated between a valve housing of the fuel injector and a wall of a receiving bore of the cylinder head, the compensating element comprising:

an intermediate ring;

support segments; and a plurality of webs at the intermediate ring that extend along the valve housing and on which the support segments are affixed, the support segments wrapping around the valve housing to distance the valve housing from the wall of the receiving bore;

wherein:

a number of the webs is two; and the support segments, by one end in each case, are affixed to one of the webs.

* * * * *

UNITED STATES PATENT AND TRADEMARK OFFICE

CERTIFICATE OF CORRECTION

PATENT NO. : 6,817,341 B2
DATED : November 16, 2004
INVENTOR(S) : Martin Scheffel It is certified that error appears in the above-identified patent and that said Letters Patent is hereby corrected as shown below:

Column 6,
Line 64, change "guandrantal" to -- quandrantal --

Signed and Sealed this

Ninth Day of August, 2005

JON W. DUDAS
*Director of the United States Patent and Trademark Office*